US005328094A

United States Patent [19]

Goetzke et al.

[11] Patent Number: 5,328,094

[45] Date of Patent: Jul. 12, 1994

[54] FUEL INJECTOR AND CHECK VALVE

[75] Inventors: Michael B. Goetzke, Orland Park; Rodney J. Bormann, Roselle; Richard W. Tupek, Naperville, all of Ill.

[73] Assignee: General Motors Corporation, Detroit, Mich.

[21] Appl. No.: 16,878

[22] Filed: Feb. 11, 1993

[51] Int. Cl.[5] ..... F02M 47/06

[52] U.S. Cl. ..... 239/88; 239/570

[58] Field of Search ..... 239/88-92, 239/570, 571; 137/533.17

[56] References Cited

U.S. PATENT DOCUMENTS

| | | | |
|---|---|---|---|
| 1,873,782 | 8/1932 | Nixon | 137/533.17 X |
| 2,144,861 | 1/1939 | Truxell | 239/90 X |
| 2,144,862 | 1/1939 | Truxell . | |
| 2,320,913 | 6/1943 | Crowell | 137/533.17 X |
| 2,569,233 | 9/1951 | Dickson et al. . | |
| 2,576,451 | 11/1951 | Dickson et al. . | |
| 2,591,401 | 4/1952 | Camner | 239/90 X |
| 2,686,503 | 8/1954 | Reddy et al. . | |
| 2,740,667 | 4/1956 | Dickson et al. . | |
| 2,898,051 | 8/1959 | Teichert . | |
| 3,403,632 | 10/1968 | Hulsing | 239/88 X |
| 4,550,875 | 11/1985 | Teerman et al. | 239/88 |

FOREIGN PATENT DOCUMENTS

| | | | |
|---|---|---|---|
| 317615 | 1/1957 | Fed. Rep. of Germany | 137/533.17 |
| 803832 | 10/1936 | France | 137/533.17 |
| 1180505 | 2/1970 | United Kingdom | 137/533.17 |

*Primary Examiner*—Andres Kashnikow
*Assistant Examiner*—Kevin Weldon
*Attorney, Agent, or Firm*—C. K. Veenstra

[57] ABSTRACT

An improved high pressure fuel injector and check valve disks therefore having annularly spaced passages including holes. A preferred embodiment for EMD diesel and dual fuel engines is a unit injector with a flat circular valve disk having a plurality of equally spaced holes located in a ring closely inward of the ledge of an associated valve cage and closely outward of the orifice or delivery opening of an associated valve seat. Alternative disk and injector embodiments are contemplated.

20 Claims, 4 Drawing Sheets

FUEL INJECTOR AND CHECK VALVE

TECHNICAL FIELD

This invention relates to high pressure fuel injectors and to check valves for use in such fuel injectors. In a preferred embodiment, the invention relates to improvements in unit fuel injectors for diesel engines and to check valves for use in such injectors.

BACKGROUND

It is known in the art relating to unit fuel injectors for diesel engines to provide a positive displacement plunger pump with a controlled output to pump fuel at high pressure through a spray tip directly into an associated combustion chamber for combustion therein. A well known feature of such injectors is the provision of a flat check valve to prevent the back flow of fuel or combustion gases from the combustion chamber and spray tip into the plunger pump location. A known type of flat check valve is in the form of a small disk having the outer edges scalloped to provide flow passages for fuel when the valve is open and seated upon an annular seat open internally to a flow chamber. Such check valves have been used for many years in some of the unit fuel injectors made by General Motors and subsequently by Diesel Technology Corporation, including those supplied for use in the well known Electro-Motive Division (EMD) diesel and dual fuel engines manufactured for railroad locomotives and other applications.

SUMMARY OF THE INVENTION

The present invention provides improved embodiments and concepts for a disk check valve for use in and in combination with high pressure fuel injectors of the type described and equivalent applications. In a preferred embodiment, the injector is a unit type diesel fuel injector, particularly one for use in EMD diesel engines and the check valve comprises a circular disk having flow passages comprising a plurality of holes equally spaced on a circle between the edge and the center of the disk. At present, seven holes are preferred. Such an arrangement has been shown to apparently provide more stable action of the check valve along with reduced pumping force required for injection at the higher fuel rates needed for recent engine applications. Improved combustion and operational efficiency have been obtained as a result.

Numerous variations of the concept are contemplated as potentially providing similar advantages.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
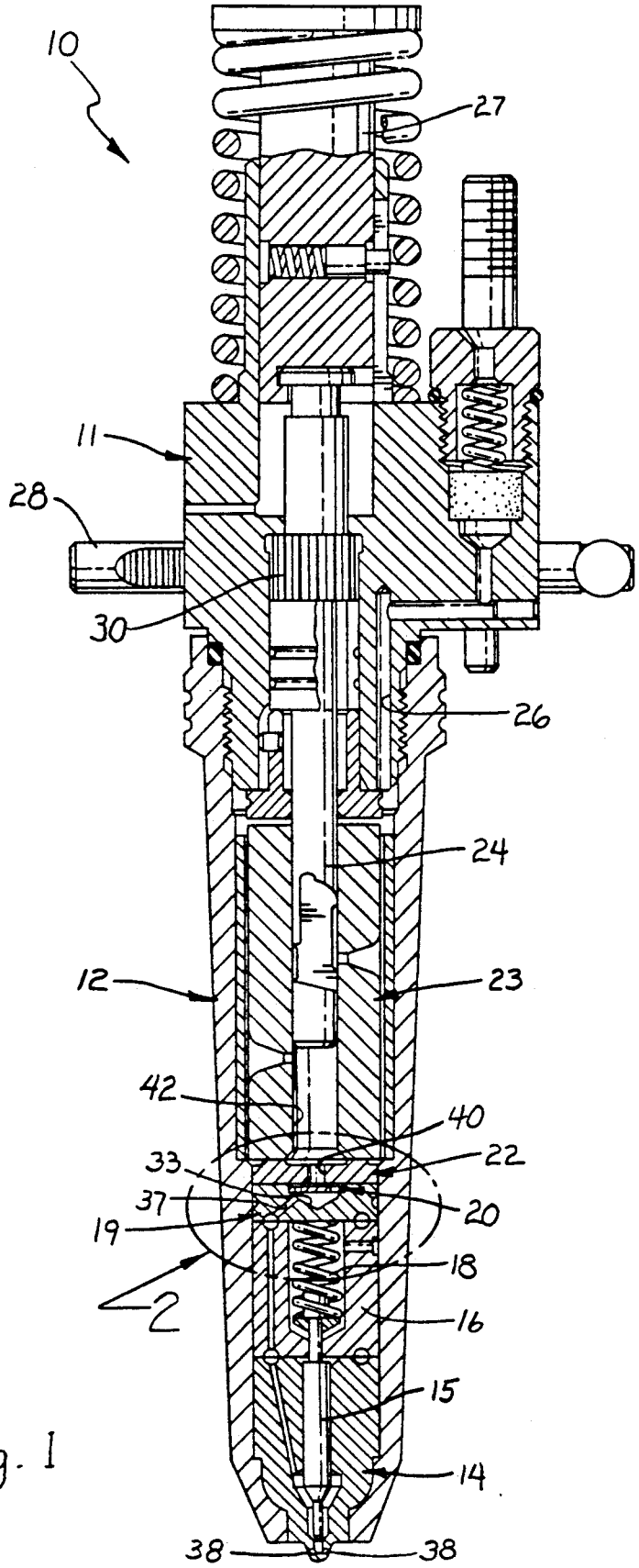
FIG. 1 is a cross-sectional view of one type of unit fuel injector for EMD diesel engines and incorporating a check valve disk according to the invention.

Referring now to the drawings in detail, numeral 10 generally indicates a fuel injector of the high pressure unit direct injection type and in particular one intended for use in engines manufactured by Electro-Motive Division (EMD) of General Motors. The illustrated injector is representative of many other high pressure direct injection fuel injectors for diesel fuel and other liquid and semi-liquid fuels which may make use of check valves in accordance with the present invention.

Injector 10 includes a body 11 and a thread attached nut 12 within which are clamped a spray tip 14 carrying a needle valve 15, a spring cage 16 carrying a valve spring 18, a check valve cage 19 carring a check valve disk 20 according to the invention, a spacer 22 and a bushing 23 receiving a reciprocable plunger 24. Passages 26 in the body and bushing supply fuel to the bushing interior for pumping under high pressure by the plunger. A follower 27 engages the plunger for actuating it mechanically in response to the engagement of a cam, not shown.

Control of the amount and timing of the fuel injected each cycle is provided by mechanical rotation of the plunger in the bushing through a rack 28 and gear 30 which varies the effective length of the pumping stroke in known manner. If desired, known means for electronically controlling the fuel rate and timing could alternatively be used.

Figure 2:
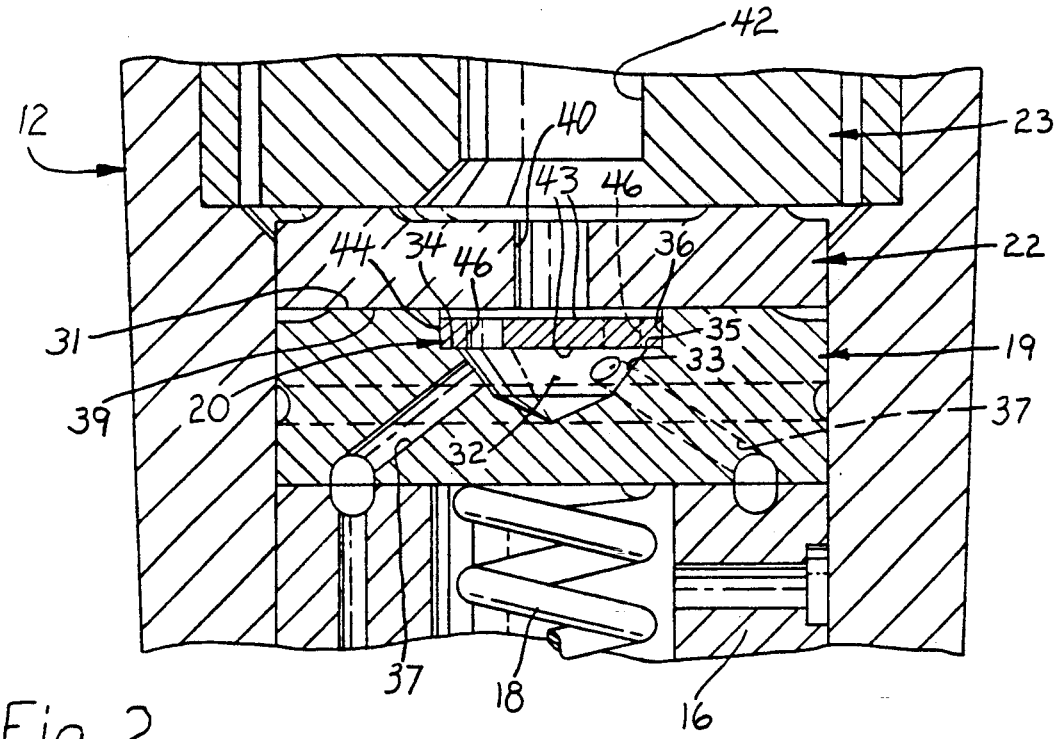
FIG. 2 is an enlarged view of the area in circle 2 of FIG. 1 showing the check valve and spacer assembly.
Figure 3:
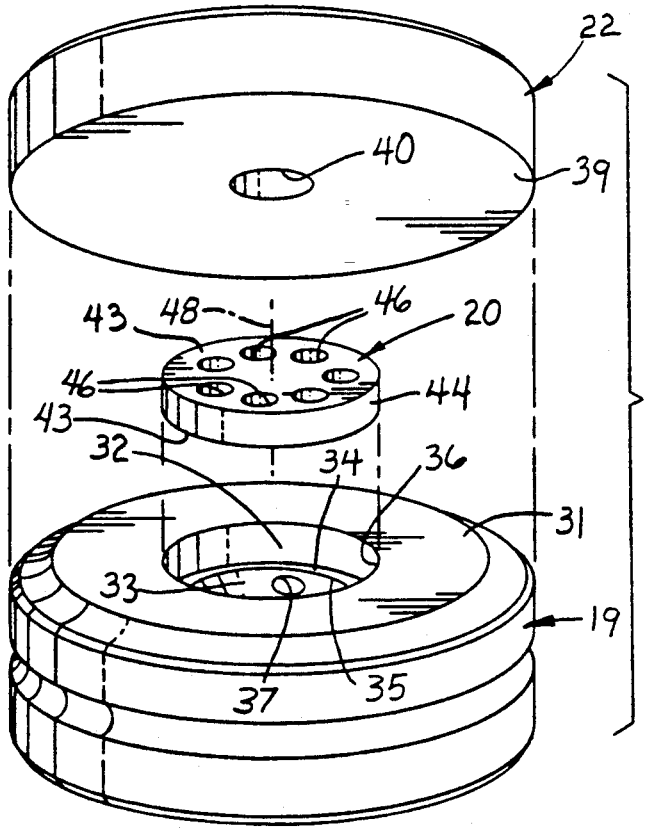
FIG. 3 is an exploded pictorial view of the assembly of FIG. 2.

As shown in FIGS. 2 and 3, the check valve cage 19 has a flat upper surface 31 with a central recess 32 defining a delivery chamber 33 surrounded by an annular abutment or ledge 34 spaced slightly below the upper surface 31 and having an inner diameter 35 defining the outer edge of the delivery chamber. A cylindrical outer rim 36 borders the ledge 34 and joins it with the upper surface 31. Delivery passages 37 extend from the chamber 33 to connecting passages in the spring cage 16 and spray tip 14 leading to orifices or spray holes 38 in the end of the spray tip and controlled by the needle valve 15.

The spacer 22 includes a flat lower surface 39 which sealingly engages the upper surface 31 of the check valve cage 19. A central delivery opening or orifice 40 connects the delivery chamber 33 with a pumping chamber 42 formed within the bushing 23 and bounded by the plunger 24. The surface 39 also comprises a valve seat 39 surrounding the orifice 40.

The check valve disk 20 has opposite flat sides 43 which are identical to avoid installation errors. It is preferably made of alloy steel and has adequate thickness to withstand the fuel pressures and seating forces and to provide suitable mass for stable operation. The outer edge 44 is circular and seats upon the ledge 34 of the valve cage 19 with close clearance to the outer rim 36.

A group of seven equally spaced holes 46 through the disk 20 are centered on a circle 47 concentric with the edge 44 and centered on an a central axis 48 of the disk. The holes are preferably all contained within in a band spaced (1) outward of a circle 49 (FIG. 4) of diameter equal to the diameter of the orifice 40 at the valve seat and (2) inward of the inner diameter of the ledge 34 that opens to the delivery chamber 33. The total area of the holes is sufficiently larger than that of the orifice 40 and passages 37 as not to significantly restrict fuel flow into the chamber 33.

In operation of the preferred embodiment, low pressure fuel is admitted through the supply passages 26 to the pumping chamber 42 when the plunger 24 is raised. Rotation of a cam, not shown, against the follower 27 cyclically reciprocates the plunger down and up, pressurizing and pumping a controlled amount of fuel from the chamber 42. The volume of pumped fuel is controlled by the position of the rack 28 and gear 30 which rotate the plunger to mechanically control the timing and volume of the fuel discharged. In other embodiments electrical or other control means might be used.

The discharged fuel is passed at high pressure through the orifice 40 and flows radially outward over the check valve disk 20 as it is seated upon the ledge 34 of its cage 19 in a valve open position. It then passes through the holes 46 into the valve cage recess 32 and out through the three passages 37 and connecting passages in the spring cage 16 and spray tip 14 where the fuel pressure opens the needle valve 15. The fuel is then atomized and delivered to the associated engine combustion chamber by passing through the spray holes 38 as is well known.

Upon cutoff of the pumping action, the pumping chamber 42 is opened to the low pressure fuel delivery passages 26 and the needle valve closes cutting off fuel delivery. Residual pressure in the delivery chamber then forces the check valve disk upward against the valve seat 39 closing the orifice 40 against the return flow of fuel and maintaining a barrier against the intrusion of cylinder combustion gases into the injector passages and the pumping chamber 42.

Figure 4:
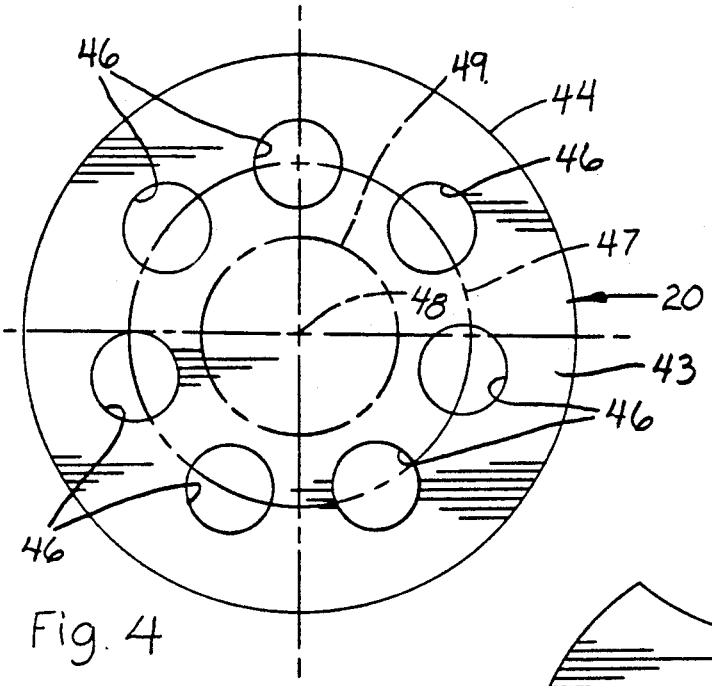
FIG. 4 is a plan view of a valve disk according to a preferred embodiment of the invention.

In a preferred embodiment for use in injectors for EMD engines and best shown in FIG. 4, the flat valve disk is made of alloy steel and has a thickness of about 0.05 inches and diameter of about 0.37 inches. Seven holes of about 0.06 inches diameter are equally spaced and centered on a circle 47 of about 0.23 inches diameter. The disk is seated on a ledge 34 having an inner diameter 35 of about 0.29 inches and has a diametral clearance averaging about 0.01 inches within the outer rim 36. The orifice 40 in the mating valve seat 39 is of about 0.13 inches diameter.

These dimensions assure that a centered disk will have a radial sealing band of about 0.02 inches between the valve seat orifice 40 and the inner edges of the disk holes 46 when the valve is closed. This is also the approximate length of the minimum radial flow path for fuel travel across the face of the disk when the valve is open. It is considered that a short flow path is desirable for stable disk operation but this is about as small as the sealing band can be made to assure positive sealing within the limits of reasonable manufacturing tolerances. On their outer edges, the holes 46 are approximately aligned with the inner diameter of the ledge 34 on which the disk rests when the valve is open. Thus, essentially the full area of the disk holes 46 is available for fuel flow.

Figure 5:
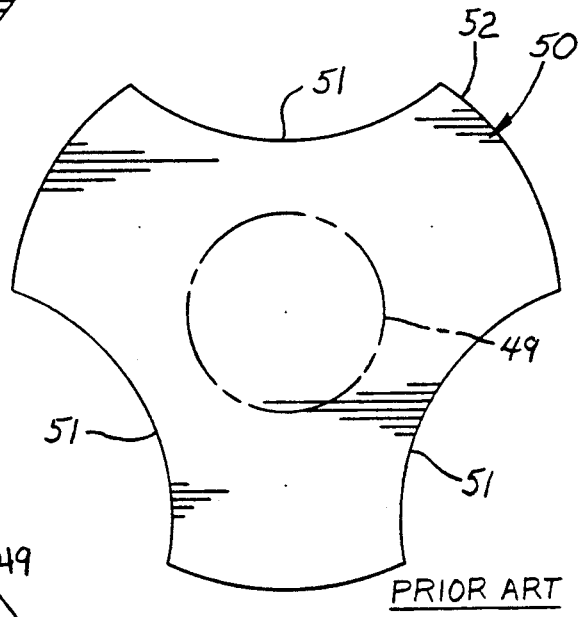
PRIOR ART Fig 5
FIG. 5 is a plan view showing a prior art valve disk.

FIG. 5 illustrates a current check valve disk 50 embodiment which has been successfully used in EMD engine injectors for many years. It is of similar material and has equivalent thickness and outer diameter dimensions to the preferred disk embodiment previously described. It differs in that instead of the seven holes of the first embodiment it has three arched cutouts 51 which could also be called scallops or slots. These cutouts extend from the outer edge 52 inward sufficiently to provide adequate area for low restriction fuel flow when the disk is seated on the ledge 34 of the previously described injector valve cage 19.

Nevertheless, at the maximum flow settings of recent high output fuel injectors, flow irregularities, called knocking, were identified which testing indicated might be due to unstable motion of the check valve disk 50 during the pumping stroke when the disk should remain seated in the ledge 34. It is conjectured that such action may have resulted from the rapid radial outflow of fuel over the upper side of the disc from the orifice 40 in the valve seat to the inner edges of the cutouts 51 causing momentary reductions in pressure above the disk sufficient to allow system pressure below the disk to lift it erratically from its seat.

The present invention avoids this erratic action by providing openings through the disc at locations which reduce the length of the radial flow path from the orifice 40 to the nearest openings for fuel flow. Tests showed that reduction of the path length from about 0.047 as found with the prior disc to no more than 0.035 inches was effective to stabilize the disc with the current maximum flow rate. This might be done by merely adding openings to the present disk between the cutouts or by replacing the cutouts with a plurality of holes as in the preferred embodiment. The latter is preferred as it further shortens the flow path and increases flow area for increased stability while reducing the stress levels to which the disk is subjected.

Figure 6:
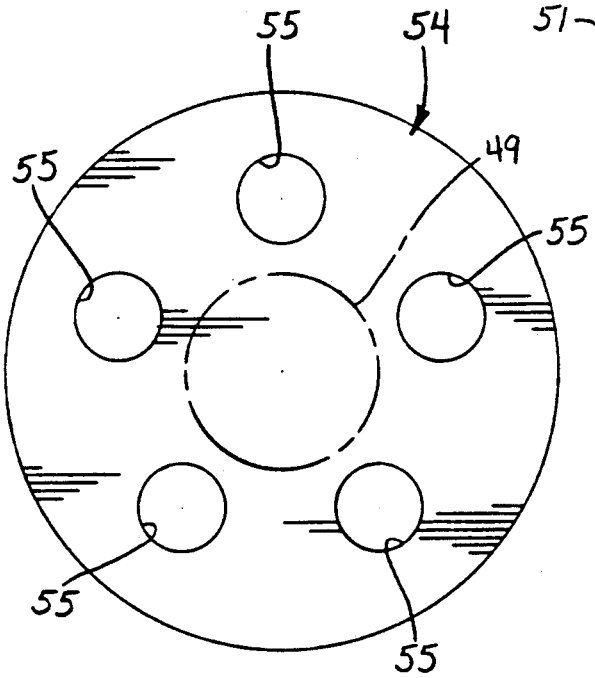
FIGS. 6–8 are plan views similar to FIG. 4 and showing exemplary alternative embodiments of check valve disks for use in high pressure fuel innectors according to the broader aspects of the invention.
Figure 7:
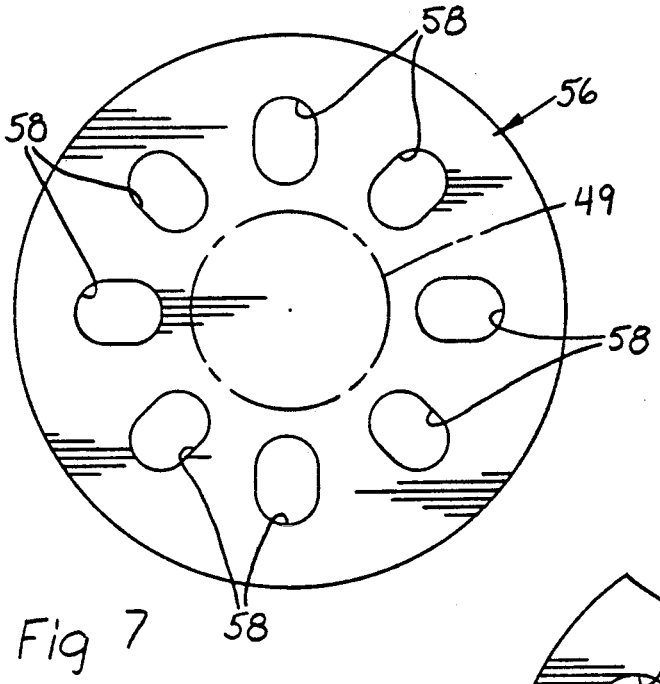
Figure 8:
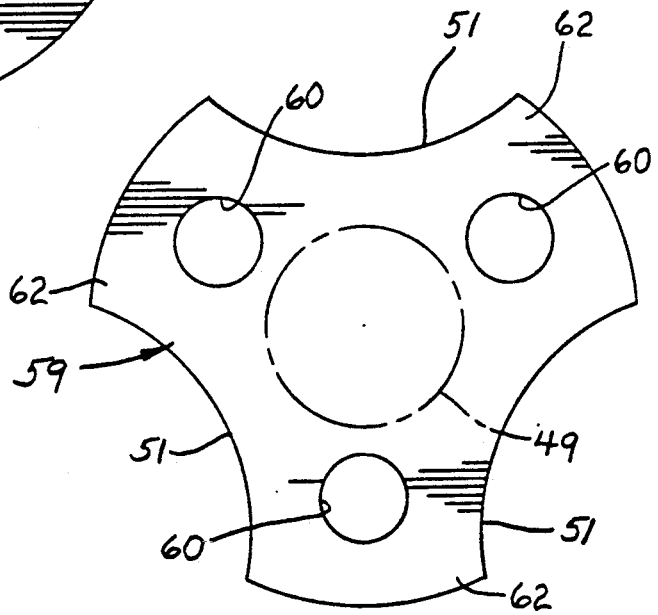

Alternative disk designs which are among those contemplated within the scope of the present invention are shown as examples in FIGS. 6–8 of the drawings. In FIG. 6, a disc 54 is shown having a circular edge but only five holes 55 equally spaced and of size equal to those of the preferred embodiment. The five holes would still provide flow area greater than the that of the orifice 40. Alternatively fewer or more holes might be acceptable in particular cases.

FIG. 7 shows a disk 56 with eight radially oblong holes 58 to increase flow area without increasing internal stresses in the disk.

FIG. 8 shows another embodiment of disk 59 where three smaller holes 60 are added to the legs 62 formed between the cutouts 51 of the previous disk embodiment.

While the invention has been described by reference to certain preferred embodiments, it should be understood that numerous changes could be made within the spirit and scope of the invention concepts described. Accordingly it is intended that the invention not be limited to the disclosed embodiments but that it have the full scope permitted by the language of the following claims.

What is claimed is:

1. A check valve for use in a high pressure unit fuel injector having a member with a central fuel delivery opening to be intermittently supplied with high pressure fuel and a flat valve seat surrounding the opening, a valve cage seated against the member and including a recess adjacent the valve seat, the recess including an annular ledge facing the valve seat, the ledge being centered on and having an inner diameter substantially larger than the delivery opening, an inwardly facing annular rim surrounding the ledge, ad a delivery chamber inward of the ledge for receiving fuel delivered from the delivery opening, said check valve comprising a disk receivable in the recess and having opposite first and second flat faces alternately seatable against the valve seat and the ledge respectively, an outer edge receivable in opposed relation to the rim and having limited radial clearance therefrom when centered in the recess, and a plurality of holes through the disk between the flat faces, the holes being located wholly outward of a circle of diameter equal tot he sum of the diameter of the delivery opening at the valve seat and the radial clearance of the centered disk, and each hole being located wholly inward of the outer edge of the disk, said holes forming at least a portion of the total flow area of flow passages extending between the opposite faces of the disk within a diameter equal to that of the inner diameter of the ledge.

2. A check valve as in claim 1 wherein said flow passages consist only of said holes.

3. A check valve as in claim 2 wherein said holes are angularly equally spaced.

4. A check valve as in claim 3 wherein there are at least five and not more than 9 holes.

5. A check valve as in claim 4 wherein there are exactly 7 holes.

6. A check valve as in claim 3 wherein the total flow area of said holes is about 1.5 times the flow area of the delivery opening.

7. A check valve disk as in claim 1 wherein the holes are of equal size and equally spaced about a circle intermediate the center of the disk and the outer edge.

8. A check valve disk as in claim 7 wherein the total area of the holes is about 10–30 percent of the face area of the disk.

9. A check valve disk as in claim 8 wherein the number of holes i not less than 5 and not more than 9.

10. A check valve disk as in claim 9 and made of steel material.

11. A check valve as in claim 1 wherein said flow passages also include cutouts extending from the edge inward of a circle equal to the inner diameter of the ledge.

12. A check valve as in claim 11 wherein said holes are located angularly between the cutouts.

13. A check valve as in claim 11 and having at least three equally spaced cutouts.

14. A check valve as in claim 13 wherein the cutouts form equally spaced legs extending to the edge of the disk and the holes are in the legs.

15. A fuel injector of the high pressure unit injection type for liquid fuels and comprising pump means including a plunger reciprocal in a bushing, supply means for supplying fuel to the bushing for high pressure pumping by the plunger, control means for controlling the amount of fuel pumped by the plunger, delivery means including a spray tip for delivering the fuel to an engine cylinder, and check valve means in the delivery means between the plunger ad the spray tip and preventing the reverse flow of fuel toward the plunger, the check valve means including a seat member having an orifice and a flat valve seat surrounding the orifice on a side toward the spray tip, a valve cage including a recess having a rim for receiving a flat check valve disk and supporting it in closely spaced relation to the valve seat and centered opposite the orifice, and a flat check valve disk movable in the recess into and out of engagement with the valve seat, the valve disk having opposite first and second flat faces seatable against the valve seat and the valve cage respectively, an outer edge engageable with the rim and having a limited radial clearance therefrom when centered in the recess, and a plurality of holes through the disk between the flat faces, the holes being located wholly outward of a circle of diameter equal to the sum of the diameter of the orifice at the valve seat and twice the radial clearance of the centered disk, and each hole being located wholly inward of the outer edge of the disk.

16. A fuel injector as in claim 15 wherein the total flow area of flow passages including the holes and extending between the opposite faces of the disk being within a range of from one to two times the flow area of the delivery opening through said member.

17. A fuel injector as in claim 15 wherein the holes have inner edges which lie within a radial distance from the orifice of the valve seat of not more than about one tenth the diameter of the valve disk.

18. A fuel injector as in claim 17 wherein the inner edges of the holes lie within a radial distance from the orifice of not more than about one sisteenth of the diameter of the valve disk.

19. A fuel injector as in claim 15 wherein the total flow area of the holes is between 1 and 2 times the flow area of the orifice.

20. A fuel injector as in claim 19 wherein said total flow area of the holes is about 1.5 times the flow area of the orifice.

* * * * *